US006109718A

United States Patent [19]

Murakami et al.

[11] Patent Number: 6,109,718

[45] **Date of Patent: *Aug. 29, 2000**

[54] RECORDING APPARATUS FOR CONTROLLING A DRIVING SIGNAL IN ACCORDANCE WITH THE TEMPERATURE IN THE APPARATUS AND METHOD FOR CONTROLLING THE DRIVING SIGNAL

[75] Inventors: Shuichi Murakami, Tokyo; Nobuyuki Kuwabara, Kawasaki; Hiroshi Tajika; Tamaki Sato, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,231

[22] Filed: Apr. 29, 1997

Related U.S. Application Data

[63] Continuation of application No. 08/172,904, Dec. 27, 1993, abandoned.

[30] Foreign Application Priority Data

Dec. 28, 1992 [JP] Japan ..... 4-347437

[51] Int. Cl.[7] ..... B41J 29/38

[52] U.S. Cl. ..... 347/14; 347/17

[58] Field of Search ..... 347/9–11, 14, 347/17, 19, 57

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,036,337 | 7/1991 | Rezanka | 347/14 |
| 5,166,699 | 11/1992 | Yano et al. | 346/1.1 |
| 5,172,142 | 12/1992 | Watanabe et al. | 347/14 |
| 5,175,565 | 12/1992 | Ishinaga et al. | 346/140 R |
| 5,485,182 | 1/1996 | Takayanagi et al. | 347/17 |

FOREIGN PATENT DOCUMENTS

| | | |
|---|---|---|
| 418818 | 3/1991 | European Pat. Off. . |
| 0496525 | 7/1992 | European Pat. Off. . |
| 505154 | 9/1992 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 63-233856 | 9/1988 | Japan . |
| 4-247951 | 9/1992 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A recording apparatus which is provided with a plurality of heads accompanied with temperature rise in recording by the application of driving signals comprises means for detecting the temperature in apparatus to detect temperatures in the recording apparatus; means for obtaining the temperature of the recording head from an offset value set between the temperature in apparatus and the temperature of the recording head of the recording apparatus in accordance with the detection by the aforesaid means for detecting the temperature in apparatus; and means for controlling the driving signal to change the waveforms of the driving signal applied to the recording head. With the structure arranged as above, the offset temperature is varied in accordance with the operational situations to obtain the head temperature without detecting it directly, hence maintaining the discharging amount constantly in printing and between environments in order to suppress the variation of the density of images to be printed, and also, reduce the cost of the printer main body and that of the head significantly.

81 Claims, 8 Drawing Sheets

RECORDING APPARATUS FOR CONTROLLING A DRIVING SIGNAL IN ACCORDANCE WITH THE TEMPERATURE IN THE APPARATUS AND METHOD FOR CONTROLLING THE DRIVING SIGNAL

This application is a continuation, of application Ser. No. 08/172,904, filed Dec. 27, 1993, now abandoned.

BACKGROUND OF THE INVENTION

1. Field of the Invention

The present invention relates to an ink jet recording apparatus. More particularly, the invention relates to an ink jet recording apparatus capable of obtaining the correct head temperature for the execution of an optimal head driving.

2. Related Background Art

There has been known an ink jet recording method whereby to form images by discharging ink onto a recording medium. The method has the advantages that a recording is possible at a high speed in a high density, and the formation of a color image is easy.

For the ink jet recording method, it is known that the temperature in a printer and the head temperature cause the viscosity of a liquid to change, resulting in the variation of the discharging amount. In other words, the viscosity of the liquid is lowered as the head temperature rises, thus making the discharging amount greater. Regarding changes in the discharging amount by the temperature in apparatus, the discharging amount is small if the temperature in the printer is low, for example, thus making the density of an image low. On the contrary, if the inner temperature is high, the density of an image is high. This difference between the inner temperatures creates a problem of varying the density which is an important element for the formation of good quality images. Here, in order to solve these problems, there has been proposed the means with which to detect the temperatures in apparatus, and prevent the discharging from being lowered even at a low environmental temperature.

At a low environmental temperature, the temperature in apparatus is detected by such a means as above, and then, in order to prevent the discharging amount from being reduced by the temperature in apparatus which is lower than a certain threshold value, a means such as a heat-retaining heater is arranged in a head and controlled to raise the head temperature. In this way, it is possible to correct the head temperature for the elimination of the phenomenon that the density becomes low at the low temperature in apparatus. However, it is still impossible to prevent the discharging amount from being increased in proportion to the temperature rise when the temperature in apparatus becomes higher than the threshold value. The density of an image becomes high due to the temperature rise of the head itself while in printing, which inevitably brings about the difference between densities in a one-page portion or within a line. This problem cannot be solved just by detecting the temperature in apparatus. Also, a specific time is required to correct the head temperature, hence a disadvantage that the throughput is reduced. Moreover, in the proposed method, it is intended to maintain the discharging amount at a desired level just by detecting the temperature in apparatus without detecting the head temperature. This means that while the required temperature parameters for a liquid jet recording apparatus are two, namely, the temperature in apparatus and the head temperature, the head temperature is not detected. As a result, the temperature difference is generated between the temperature in apparatus and the head temperature. A deviation ensues from this difference with respect to the maintenance of the target discharge amounts, thus making the exact control of the discharging amount impossible. Also, in the prior art, a single pulse is given per discharge. With this, the discharging amount cannot be controlled exactly, either.

In this respect, as a method for controlling the discharging amount in an ink jet recording apparatus, there has been proposed the one in which plural pulses are given per ink droplet, such as disclosed in Japanese Patent Laid-Open Application No. 4-247951, U.S. patent application Ser. No. 104,261 (a continuation of U.S. Ser. No. 821,773) and European Patent Laid-Open No. 496,525. The proposed method relates to an ink jet recording which utilizes thermal energy for discharging ink. As a specific example, there has been the one known as thermal jet method which uses the electrothermal transducers arranged in the vicinity of the discharging ports for the generation of the thermal energy in response to pulses, and then, by the thermal energy thus generated, air bubbles are formed in ink for the purpose of discharging it.

FIG. 11 is a view showing an example of such pulses. For the pulses shown in FIG. 11, a pulse P1 supplying the energy which is retained within a range so that no ink discharge is allowed is applied to the electrothermal transducers for the purpose of raising the temperature of ink near the electrothermal transducers. At interval of the time P2 which presents the period during which the pulse is quiescent, a pulse P3 is provided for discharging ink. The temperature of ink near the electrothermal transducers is controlled by changing the thermal energy given by the pulse P1. Thus, the characteristic properties of ink that its viscosity changes according to temperatures are utilized to change the foaming volume by the application of the pulse P3 for discharging ink. In this way, it is possible to control the discharging amount.

Now, by combining this driving method and a method for detecting the head temperature, another method is proposed for the provision of a control in order to improve the image quality. The driving control method is such that the head temperature is detected when the printing signals are inputted, for example, and then, the driving parameters are set to obtain the target discharging amount at the time of the temperature detection. Subsequently, the head temperatures are detected at time intervals which are arbitrarily set during the period of printing so that the driving parameters are modified at any time to match those at which the target discharging amount is obtainable. In this way, it becomes possible to suppress the difference in densities caused by the temperature in a printer and also the difference in densities in a page and in a line due to the temperature rise of the head itself in printing.

Now, to do this control, means for detecting the head temperature must be provided. For example, it is possible to arrange such a means for detecting the head temperature by providing a temperature sensor (such as diodes or aluminum) fabricated on a substrate by a film formation method as in the case of providing the electrothermal transducers in the head. However, when the temperature sensor is formed by the film formation process, the individual difference takes place in the film thickness of each sensor to be formed. This individual difference in the film thickness produces the individual differenc in the resistance value of each temperature sensor. Since the resistance value of the temperature sensor is used for detecting the temperature, the resultant outputs at the same temperature tend to differ from each other (FIG. 13). Nevertheless, although the value of the initial output of each sensor at the same temperature has the individual difference, its temperature-dependent coefficient is constant. The temperature-dependent coefficient is defined as follows:

$$\text{Temperature-dependent coefficient}=(Sa-Sb)/(Ta-Tb)$$

where Sa is the value of sensor output (T=a), Sb is the value of sensor output (T=b), Ta is the temperature=a, and Tb is the temperature=b.

Since the irregularities exist between the individual sensors as described above, the rank classification is arranged according to the prior art as means to correct such irregularities when each of the sensors is prepared. In order to know the absolute temperature using such temperature sensor, the rank classification functions as means to correct the differences in the temperatures obtained by reading the values of sensor outputs corresponding to the initial values of resistance. Then, the following is required for the execution of the rank classification:

At first, the width of the sensor resistance value (width of resistance value in one rank) is set within a range which does not create any problems that may affect images to be formed.

Then, the total range of the individual differences of the sensor resistance values are divided by the width of one-rank resistance value for the preparation of a rank table containing the sensor resistance values and ranks.

The sensor resistance values are measured when the sensors are manufactured, and then, in accordance the above-mentioned table, a pattern cutting is provided for the head to enable the printer main body to discriminate one rank from another by following the pattern cutting. Then, in accordance with the output value and temperature per rank stored in the printer main body, the temperatures are detected. According to the temperatures thus detected, the driving pulses are set. However, in order to classify the ranks of the temperature sensors, the number of processing steps is inevitably increased at the time of manufacture. The production yield is also lowered. Yet, in this respect, not only resistors are needed for the head to execute the pattern cutting, but also a specific circuit is needed for the printer main body to recognize the different ranks. Therefore, the means for detecting the head temperature for the purpose of eliminating the deviation which tends to take place in the temperature in apparatus and the head temperature brings about the significant cost increase eventually.

As described above, according to the prior art, the driving control is given after having detected the temperature in apparatus. However, as the difference is created between the temperature in apparatus and the head temperature, the discharging amount cannot be controlled appropriately, hence leading to the generation of the density differences. Also, as a countermeasure to it, a method is provided to detect the head temperature, but this method necessitates the rank classification of the temperature sensors, which inevitably increases the cost of manufacture and lowers the product yield. Furthermore, for a liquid jet recording apparatus, means for detecting the sensor ranks must be provided as an additional constituent, which also affects the cost in fabricating the apparatus main body.

SUMMARY OF THE INVENTION

The present invention is designed to solve the above-mentioned problems. It is an object of the invention to provide a driving control at a low cost, which is capable of preventing the discharging amounts from varying by changes in such amounts due to the environmental temperature and the temperature rise of the head itself.

It has been found by the inventor et al hereof that the head temperatures can be corrected by providing a variable offset temperature between the temperature detected by the sensor for the temperature in apparatus, which is arranged for the printer main body, and the head temperature which cannot be detected in that way.

In accordance with such a knowledge, the present invention is made and is characterized in an ink jet recording apparatus which discharges ink for recording by the thermal energy which is generated by the heat generating elements of a recording head when driving signals are applied, comprising:

temperature detecting means for detecting the temperature in apparatus after correcting the absolute temperature;

means for providing an offset temperature between the temperature of the recording head and the temperature in apparatus in order to obtain the temperature of a recording head by the sum of the detected temperature by the aforesaid temperature detecting means and the aforesaid offset temperature; and control means for changing the waveforms of the aforesaid driving signals in accordance with the temperature of the recording head.

Also, the present invention is characterized in an ink jet recording apparatus which discharges ink for recording by the thermal energy which is generated by the heat generating elements of a recording head when driving signals are applied, comprising:

first temperature detecting means for which no absolute temperature correction is made; and second temperature detecting means for which the absolute temperature correction is made, wherein the waveforms of the driving signals are changed by an offset temperature calculated from the values of outputs of the aforesaid first and second temperature detecting means, and the temperature of the recording head calculated from the output value of the second temperature detecting means.

In this way, it is made possible to suppress the variations of the image density by maintaining the discharging amount constantly in printing and between the different environments with the provision of an offset temperature between the temperature in apparatus detected by the sensor and the head temperature without any direct detection of the head temperature, and then, by varying the offset temperature according to the situations. Also, according to the present invention, it is possible to reduce the cost of the printer main body and the head significantly.

DETAILED DESCRIPTION OF THE PREFERRED EMBODIMENTS

Hereinafter, with reference to the accompanying drawings, the description will be made of the preferred embodiments according to the present invention.

(First Embodiment)

Figure 1:
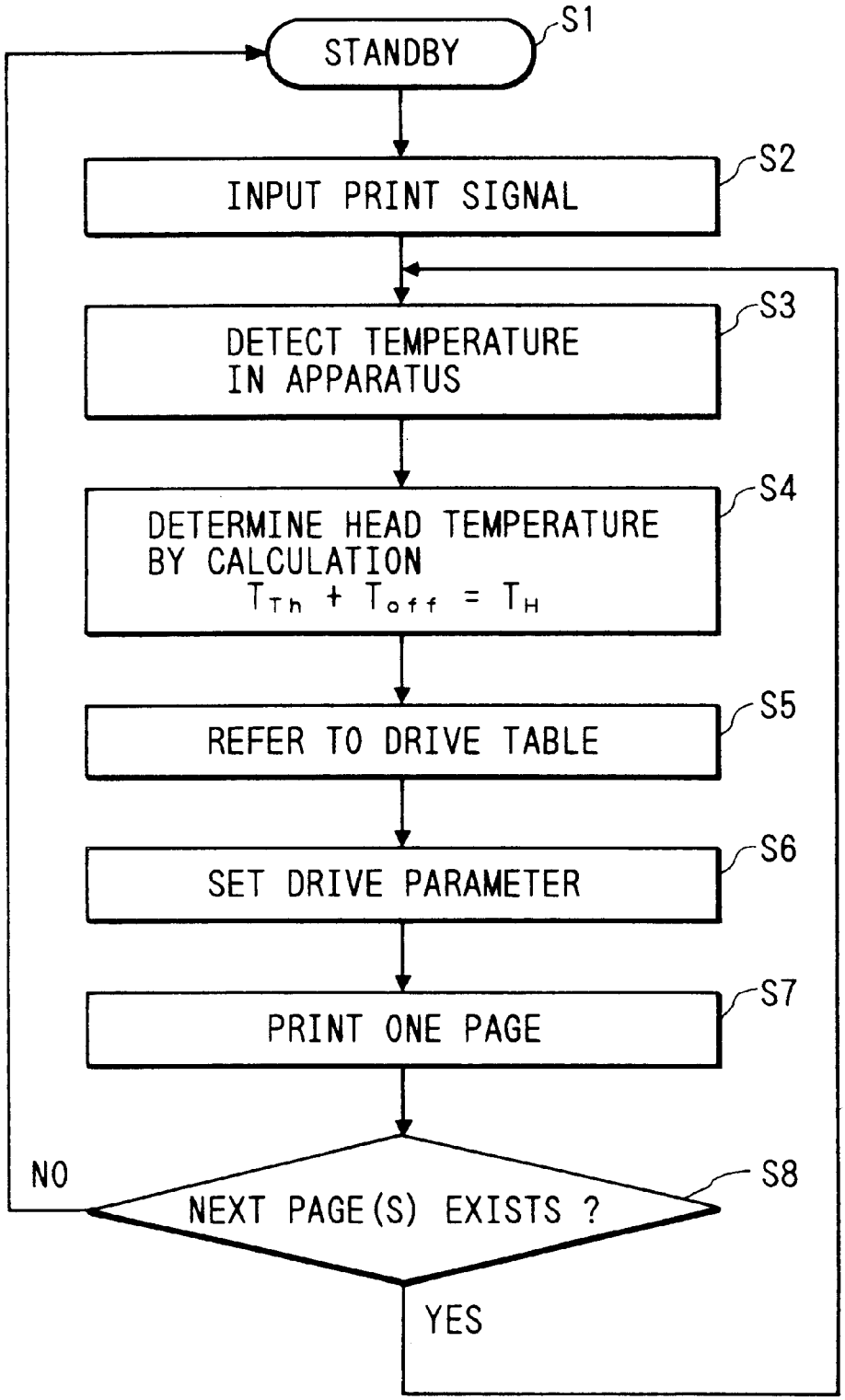
FIG. 1 is a block diagram showing the driving sequence according to a first embodiment of the present invention.
Figure 2:
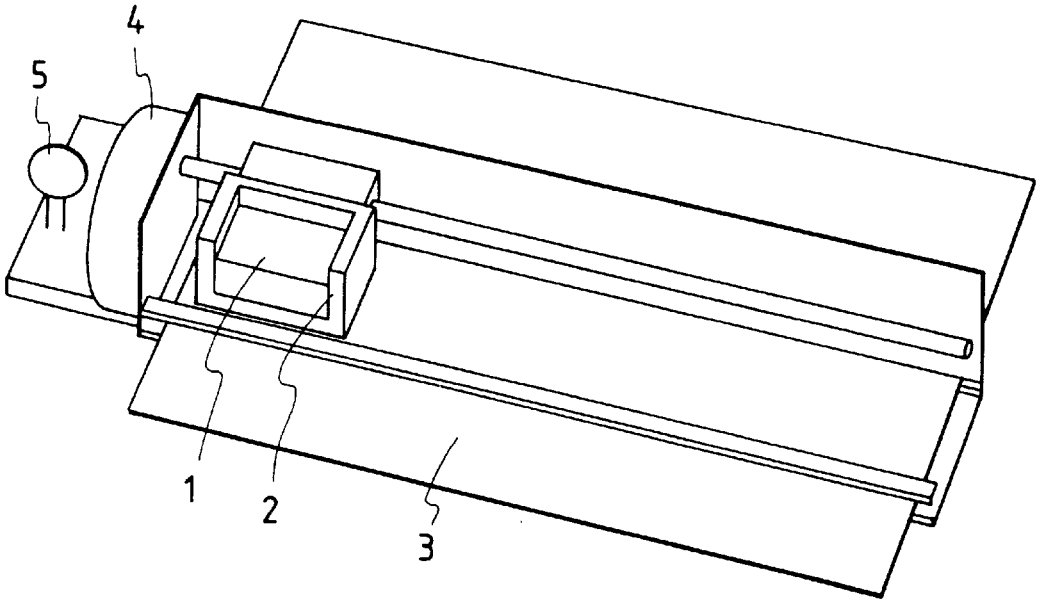
FIG. 2 is a view showing a recording apparatus used for description of the embodiments.
Figure 3:
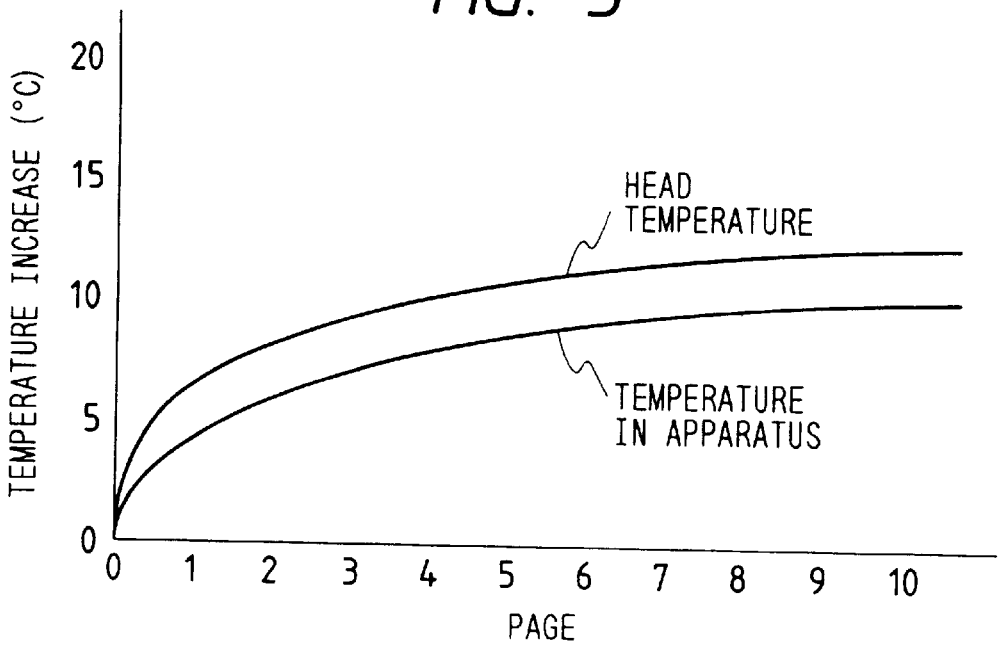
FIG. 3 is a graph showing the relationship between a page and the portion of the temperature rise according to the first embodiment of the present invention.

FIG. 1 is a view representing the characteristics of the present invention most appropriately, and is a block diagram of the driving sequence when using only the sensor for detecting the temperature in apparatus. In this case, a printer is provided with a disc type thermistor as a sensor for detecting the in-apparatus temperature. The printing head has 64 nozzles of 360 DPI. No sensor for detecting the head temperature is provided. The structure of the printer is illustrated in FIG. 2, in which a reference numeral 1 designates a printer head; 2, a carriage which enables the printer head to scan; 3, a printing sheet; 4, a carriage motor; and 5, an in-apparatus temperature sensor. The driving frequency is 4.2 (kHz). FIG. 3 shows the results of measurements of the in-apparatus temperature and the head temperature per page when standard documents are continuously printed by this apparatus with fixed driving pulses.

Figure 4:
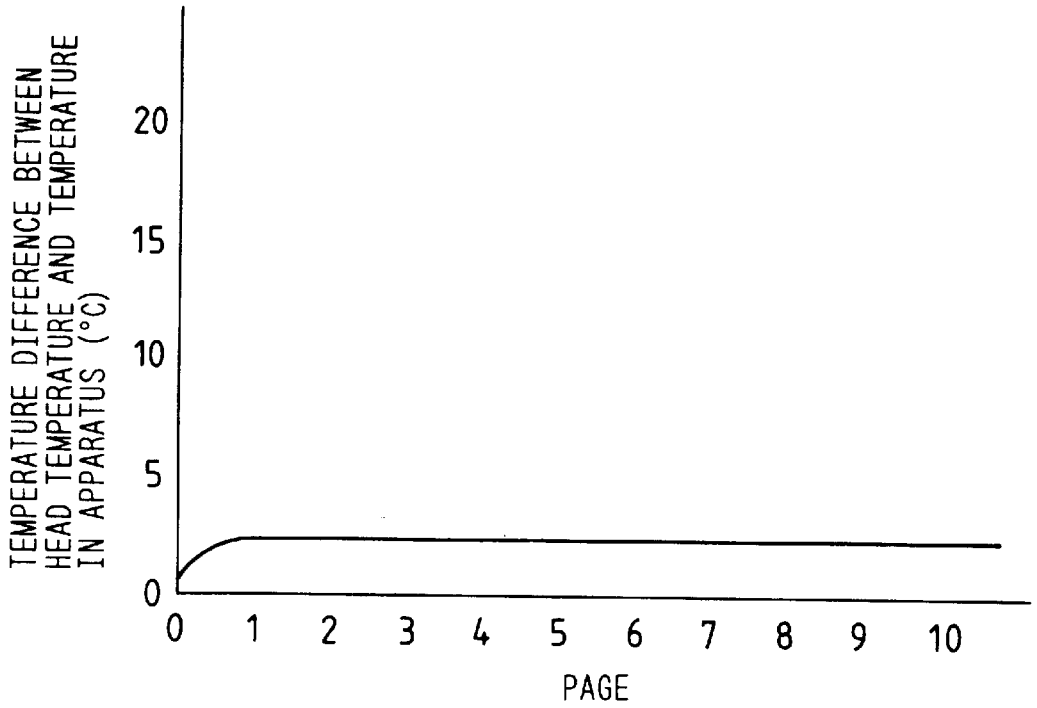
FIG. 4 is a graph showing the relationship between a page and the difference between the head temperature and the temperature in apparatus according to the first embodiment of the present invention.
Figure 5:
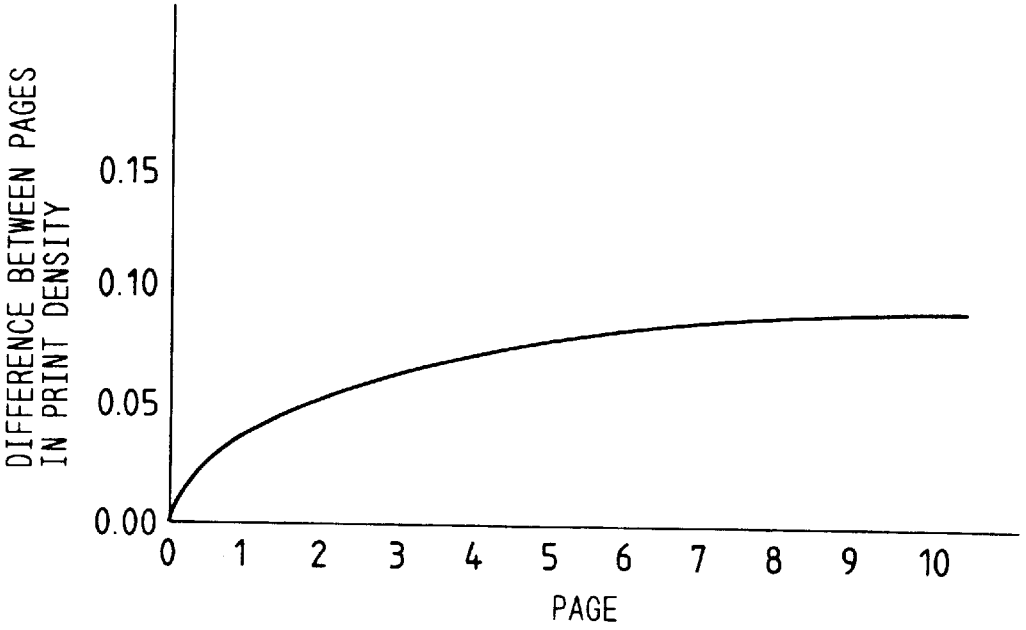
FIG. 5 is a graph showing the relationship between a page and the difference in print density.

Also, as shown in FIG. 4, the difference ($\Delta T$) between the in-apparatus temperature and the head temperature is maintained constantly when measured by this apparatus in the environment having different temperatures of 15, 25, and 35(° C.). In the present embodiment, the $\Delta T$ is 3° C. Also, in FIG. 5, the density per printed page is shown. From the graph shown in FIG. 5, it is clear that the density becomes higher in the latter pages, and that as the head temperature rises, the record density becomes higher.

From the above, it is understandable that the head temperature is obtainable from the in-apparatus temperature by providing an offset between the head temperature and the in-apparatus temperature.

Now, in accordance with the flowchart shown in FIG. 1, the description will be made of the steps to set the driving parameters corresponding to a head temperature by obtaining the head temperature from the in-apparatus temperature.

At first, when a printing signal is inputted in step S1, the in-apparatus temperature ($T_{TH}$) is detected by a sensor for in-apparatus temperature in step S3. Then, in step S4, the difference between the in-apparatus temperature which is obtained in advance by experiments and the head temperature is given as an offset ($T_{off}$) by use of the in-apparatus temperature ($T_{TH}$), thus obtaining the head temperature ($T_H$: $T_H=T_{Th}+T_{off}$) by calculation. Then, referring to the drive table shown in Table 1 in step S5, the driving parameters are set in step S6 for the head temperature $T_H$. In step S7, a page is printed. If printing data are ready for the next page, the process will return to the step S3, thus setting the parameters likewise to execute the next printing. If no printing data exist for the next page, the process will return to the step 1 in which the apparatus is on standby.

Figure 11:
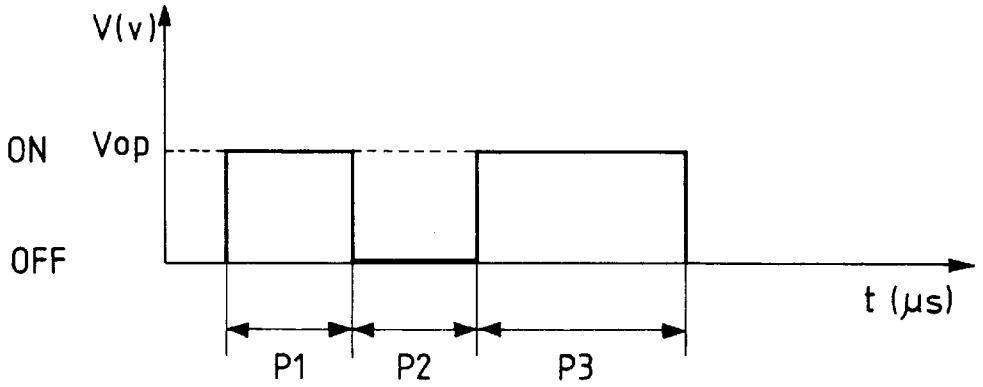
FIG. 11 is a graph showing a driving signal according to the prior art.

Here, the driving parameters are set to provide the time widths of P1, P2 and P3 shown in FIG. 11, and in the present embodiment, the P1 is arranged to change per temperature.

TABLE 1

| in-apparatus temperatures (° C.) | offset temperatures (° C.) | head temperatures (° C.) | driving parameters P1/P2/P3 (μs) |
|---|---|---|---|
| Less than or equal to 15 | 3 | –18 | 1.75/5.0/8.0 |
| 15–20 | 3 | 18–23 | 1.50/5.0/8.0 |
| 20–25 | 3 | 23–28 | 1.25/5.0/8.0 |
| 25–30 | 3 | 28–33 | 0.75/5.0/8.0 |
| 30–35 | 3 | 33–38 | 0.50/5.0/8.0 |
| 35–40 | 3 | 38–43 | 0.25/5.0/8.0 |
| more than or equal to 40 | 3 | 43– | 0.00/0.0/8.0 |

As described above, with the provision of an offset between the head temperature and the in-apparatus temperature, it is possible to obtain a head temperature from the in-apparatus temperature. In this way, it becomes possible to eliminate the difference in densities between the printed pages without providing any sensor for detecting the head temperature for the printing head, thus enabling the cost to be reduced while increasing the product yield. Also, there is no need for the printer main body to be equipped with any function to detect the output of the head temperature sensor. Therefore, a printer can be provided at a low cost.

(Second Embodiment)

Figure 6:
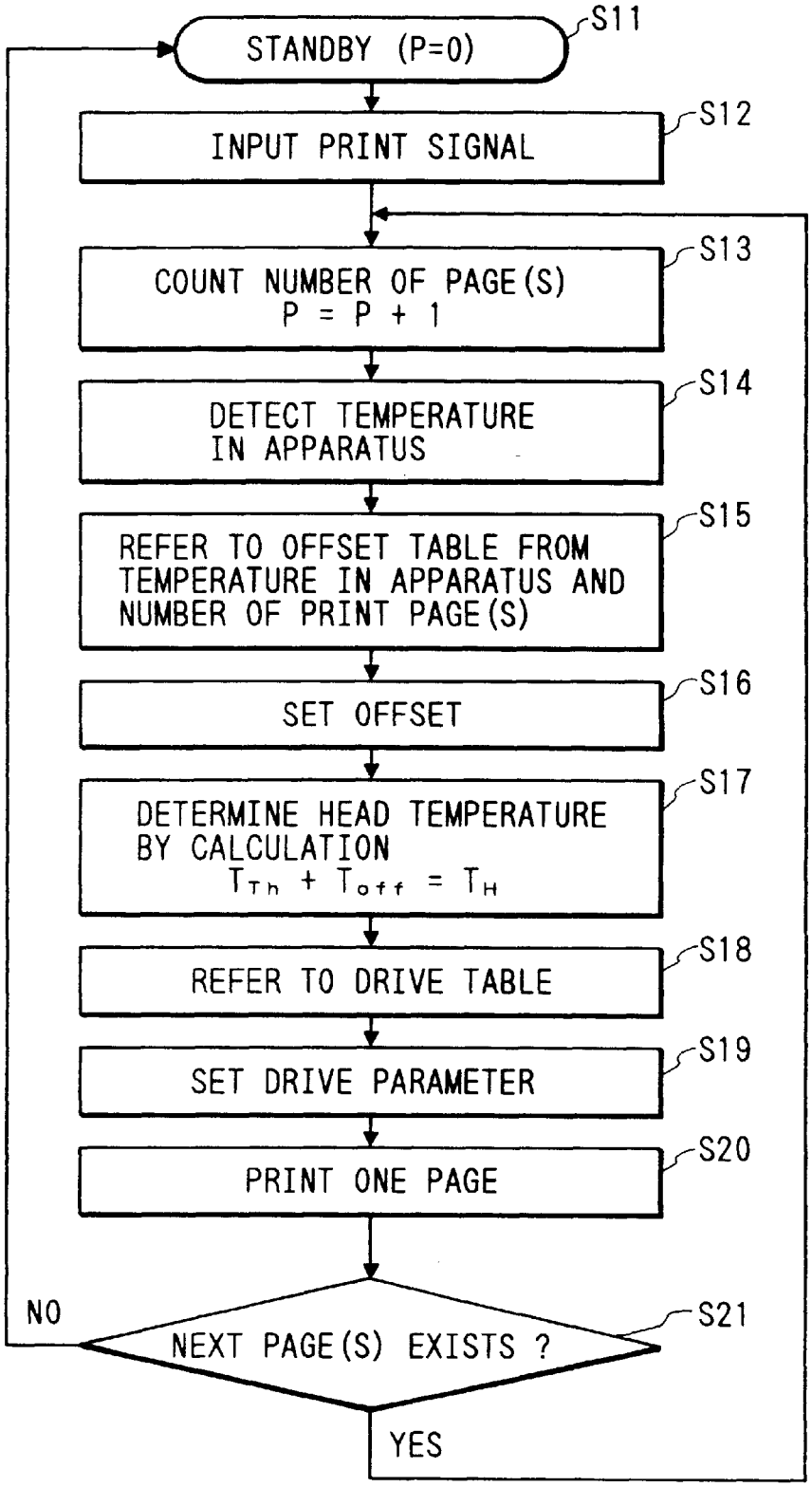
FIG. 6 is a block diagram showing the driving sequence according to a second embodiment of the present invention.
Figure 7:
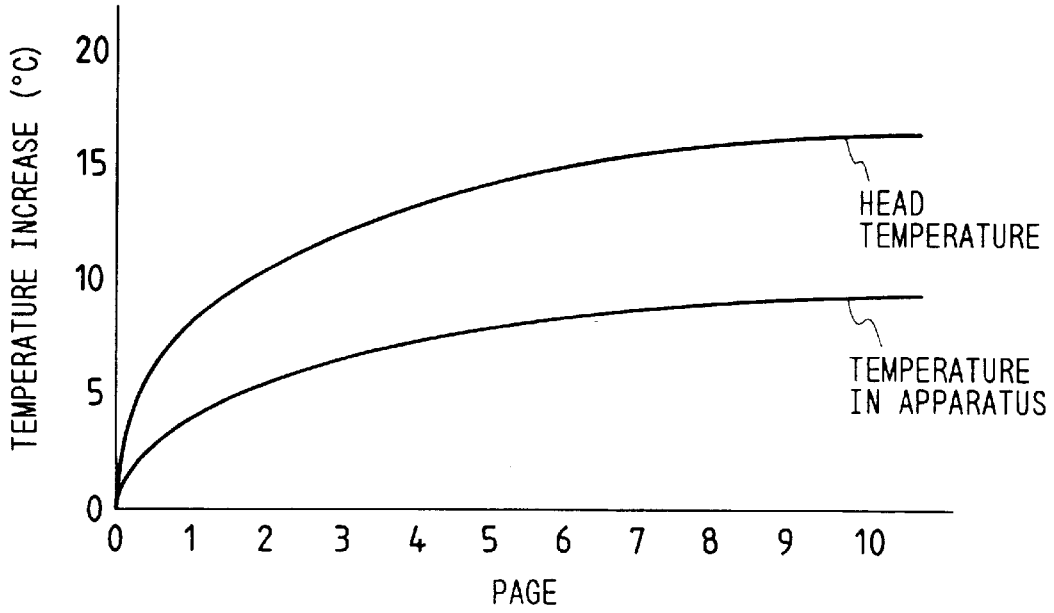
FIG. 7 is a graph showing the relationship between a page and the portion of the temperature rise according to the second embodiment of the present invention.
Figure 8:
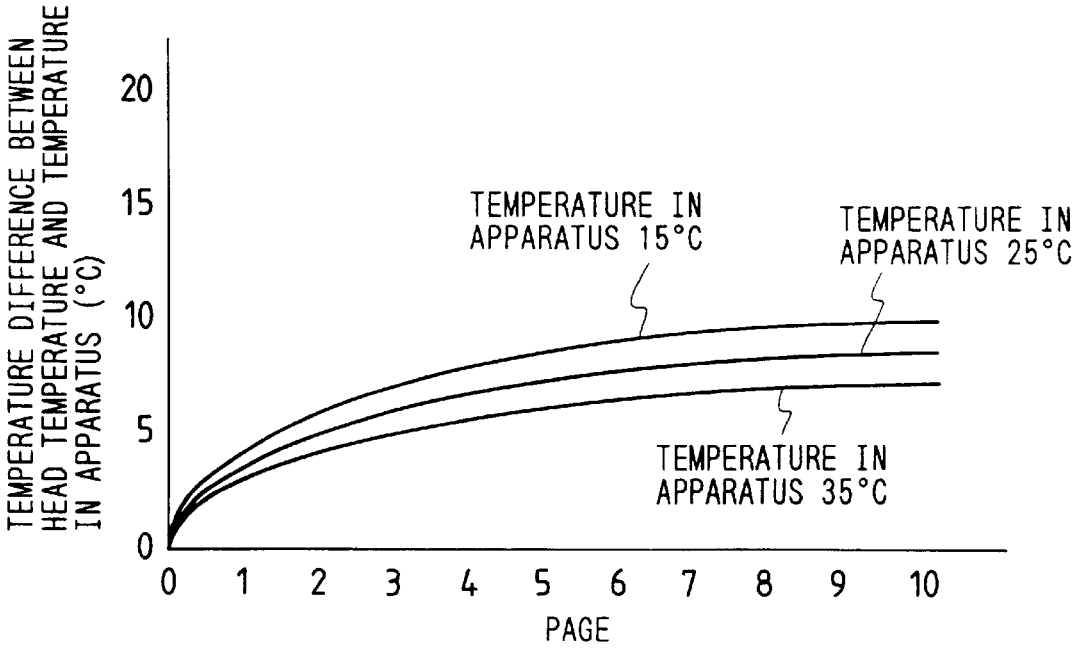
FIG. 8 is a graph showing the relationship between a page and the difference between the head temperature and the temperature in apparatus according to the second embodiment of the present invention.

FIG. 6 represents a second embodiment according to the present invention, and is a block diagram showing the driving sequence when using only a sensor for detecting the in-apparatus temperature. A printer used for the present embodiment is the one shown in FIG. 2. The driving frequency is 5.4 (kHz). FIG. 7 shows the results of measurements of the in-apparatus temperature and the head temperature per page when standard documents are continuously printed by this apparatus while fixing the driving pulses in an environment of 25(° C.). Since the driving frequency differs from that in the first embodiment, the condition of the temperature rise of the head itself changes. Thus, as shown in FIG. 8, the difference ($\Delta T$) between the in-apparatus temperature and the head temperature is not constant with respect to the in-apparatus temperatures and the number of the printed sheets. Therefore, an offset table is prepared, in which the offset temperatures shown in Table 2 are made functions of the in-apparatus temperatures and the number of printed sheets which are continuously printed. In this way, it is possible to suppress the deviation in the temperature difference between the in-apparatus and head temperatures to an extent that such a deviation does not present any printing problems. Also, in the offset table, the difference between the in-apparatus and head temperatures is zero on the first page. Like this, it is assumed that there is no difference between the in-apparatus and head temperatures on the first page. In this way, no difference is created in the print density in the continuous printing operation.

Now, with reference to a flowchart shown in FIG. 6, the description will be made of the steps to set the driving parameters from the detected temperature in apparatus.

At first, in step S11, a printed sheet counter P is reset to zero while the apparatus is on standby. Then, in step S12, a printing signal is inputted, and in step S13, the printed sheet counter P is incremented by one. In step S14, the in-apparatus temperature ($T_{Th}$) is detected. In the next step S15, the offset table shown in Table 2 is referred to for the number of printed sheets P and the in-apparatus temperature $T_{Th}$. In the next step S16, an offset ($T_{off}$) is set, and in step S17, the head temperature ($T_H$) is obtained by a calculation of ($T_H=T_{Th}+T_{off}$). In step S18, the drive table is referred to, and in the next step S19, the driving parameters are set from the drive table which is referred to. The drive table in this case is substantially the same as the one shown in Table 1. In this respect, it will suffice if only the head temperatures are allowed to correspond to the driving parameters. Using the driving parameters set in the step S19, the printing is executed on one page in step S20, and then, if no printing signal is given in step S21 for the next page, the process will return to the step S11 in which the apparatus is on standby. If there is a printing signal for the next page in the step S21, the process will proceed to step S13, and the printed sheet counter is incremented by one.

The driving parameters shown here have the same widths of the driving pulses shown in FIG. 11 as in the case of the first embodiment.

Figure 9:
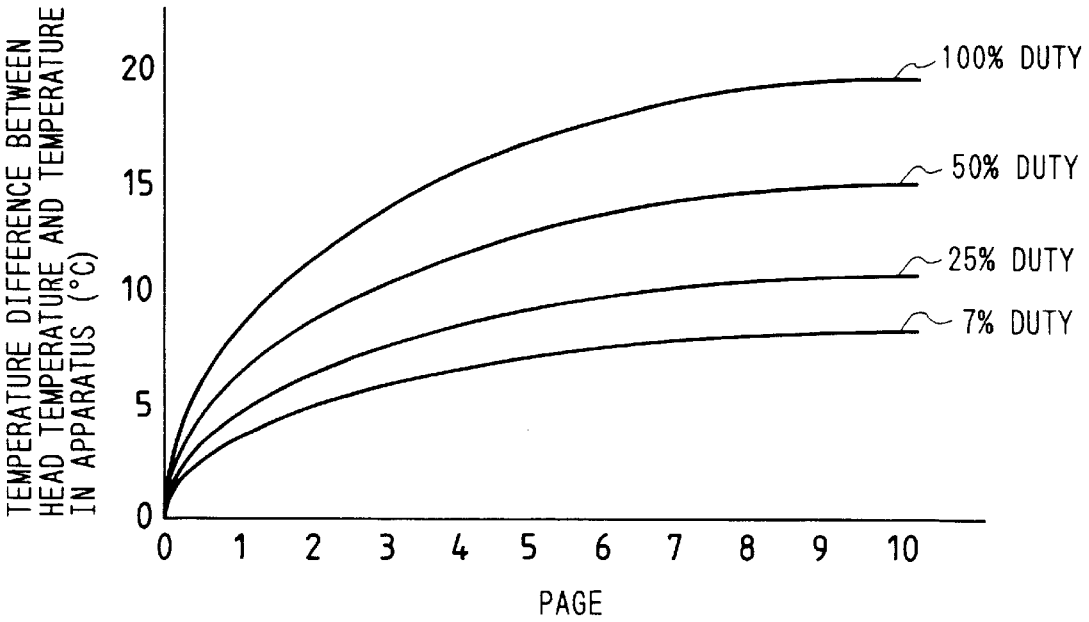
FIG. 9 is a graph showing the relationship between a page and the difference between the head temperature and the temperature in apparatus per duty according to the second embodiment of the present invention.

With the driving sequence described above, it is possible to obtain the head temperature by making the offset amounts an offset table corresponding to the in-apparatus temperatures and head temperatures or making them the functions thereof even if the differences between the in-apparatus temperature and the head temperature are not constant. In this way, the density difference per page can be reduced. Also, since it is known that the offset temperature varies according to the print duty and the environmental temperature (FIG. 9), it is possible to include this known factor in the offset table.

TABLE 2

| | in-apparatus temperature (° C.) | | | | | |
|---|---|---|---|---|---|---|
| number of printed sheets | less than or equal to 15 | 15–20 | 20–25 | 25–30 | 30–35 | More than or equal to 35 |
| 1–2 | 5.0 | 4.5 | 4.5 | 4.0 | 3.5 | 3.0 |
| 3–4 | 7.0 | 6.5 | 6.0 | 5.5 | 5.0 | 4.5 |
| 5–6 | 8.0 | 7.5 | 7.0 | 6.5 | 6.0 | 5.5 |
| 7–8 | 9.0 | 8.0 | 7.5 | 7.0 | 6.5 | 6.0 |
| 9–10 | 10.0 | 9.0 | 8.5 | 8.0 | 7.5 | 7.0 |
| more than or equal to 11 | 11.0 | 10.0 | 9.5 | 9.0 | 8.5 | 8.0 |

(Third Embodiment)

Figure 10:
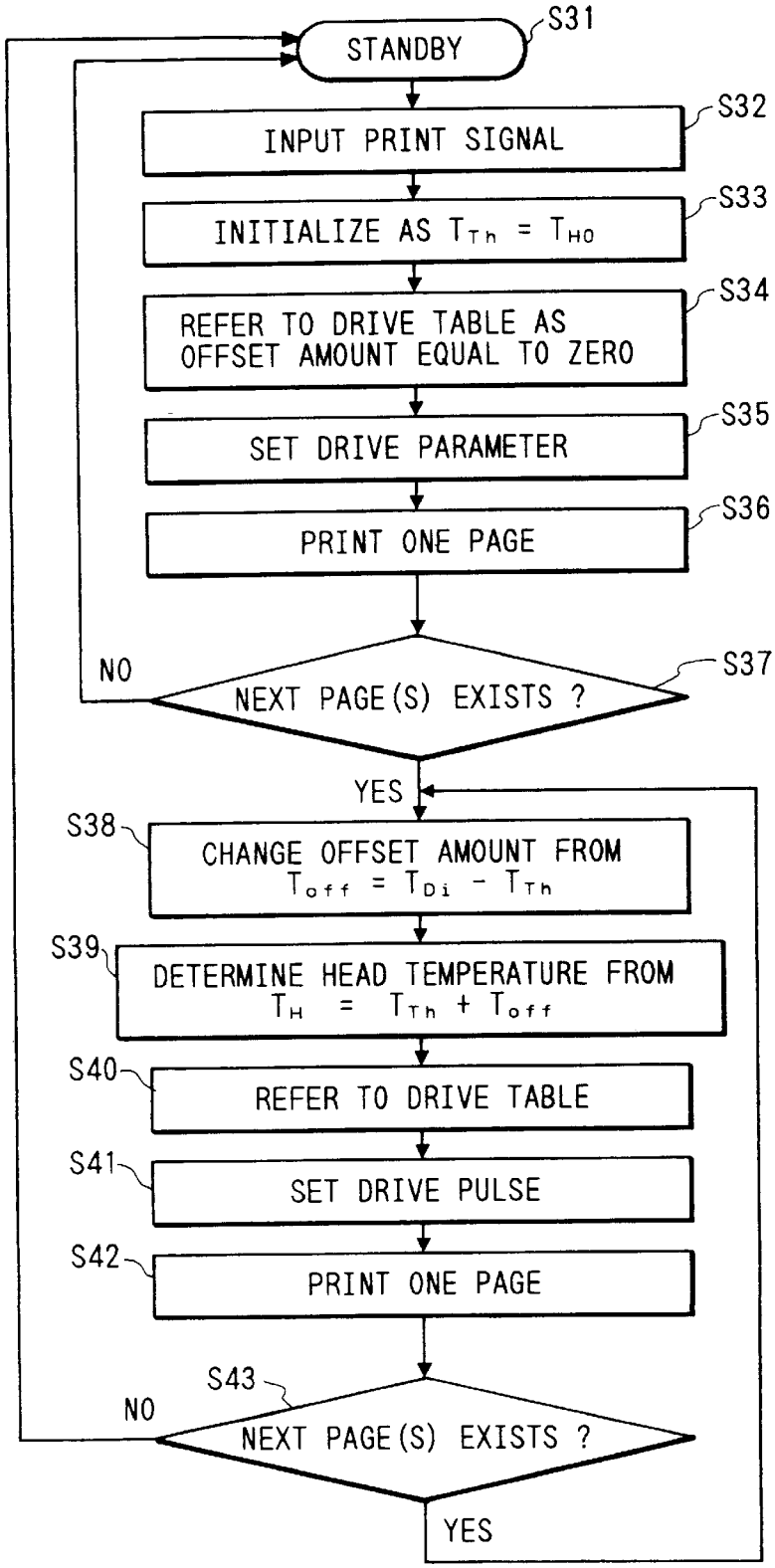
FIG. 10 is a block diagram showing the driving sequence according to a third embodiment of the present invention.
Figure 12:
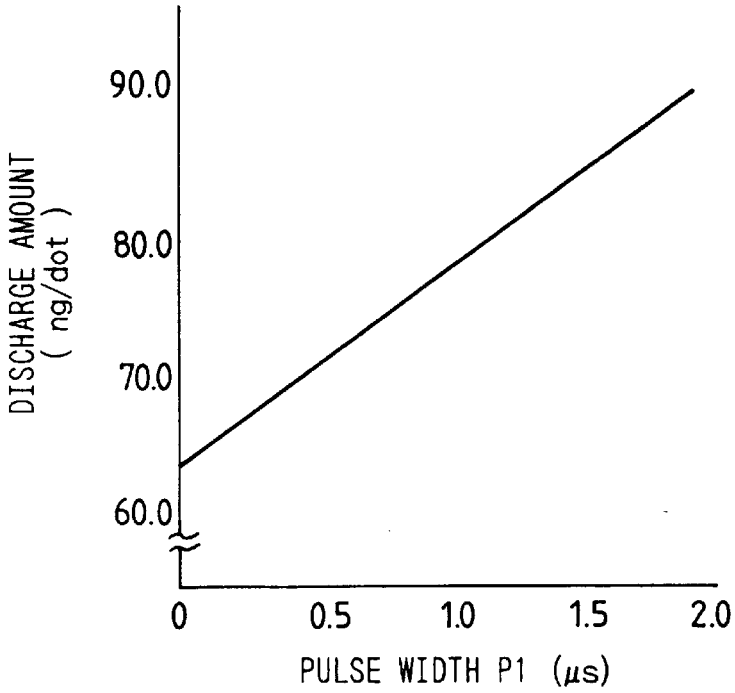
FIG. 12 is a graph showing the relationship between the pulse width and the discharging amount according to the prior art.
Figure 13:
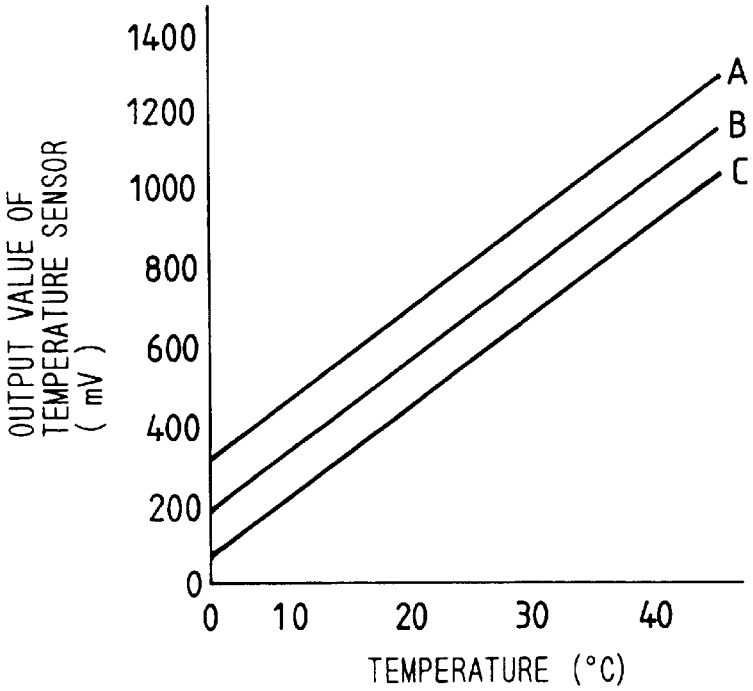
FIG. 13 is a graph showing the relationship between the temperature and the output value of a temperature sensor according to the prior art.

FIG. 10 represents a third embodiment according to the present invention, and is a flowchart showing the driving sequence for setting an offset amount by the use of a sensor for detecting the head temperature, to which no correction is added at the time of manufacture. The printing head has 64 nozzles of 360 DPI and is provided with a head temperature sensor. The driving frequency is 5.4 (kHz). The offset amounts in the first and second embodiments are set on the basis of the characteristics obtainable in printing the standard documents. There are some cases where the difference between the in-apparatus and head temperatures differs from the offset amount which is set on the basis of printing the standard documents because when an image such as a pattern having a high print duty is printed, for example, the print duties differ from the printing of the standard documents. In consideration of such possibilities, an offset amount is set by use of the head temperature sensor to which no correction is added.

Now, in conjunction with the flowchart shown in FIG. 10, the sequential steps will be described.

In step S32, a printing signal is inputted, and in step S33, the temperature ($T_{Th}$) detected by the in-apparatus temperature sensor and the temperature ($T_{Ho}$) detected by the head temperature sensor are initialized as $T_{Th}=T_{Ho}$.

Then, in step S34, the offset amount is set at "0" with the in-apparatus temperature as a reference, and, referring to the drive table, the driving parameters are set in step S35. After a one-page printing is executed in step S36, whether or not the data for the next page is ready is determined in step S37. If no data exist for the next page, the process will return to the step S31 where the apparatus is on standby until a printing signal is inputted. If any data exist for the next page in the step S37, the process will proceed to step S38 and change the offset amount. Given the offset amount as $T_{off}$, the output value of the diode sensor for the head, as $T_{Di}$, and the in-apparatus temperature as $T_{Th}$, the offset amount which is newly set in the step S38 is calculated by $T_{off}=T_{Di}-T_{Th}$. Then, in step S39, the head temperature of $T_H$ ($T_H=T_{Th}+T_{off}$) is obtained. In step S40, referring to the drive table, the driving parameters are set in the next step S41. Then, in step S42, a one-page portion is printed in accordance with the driving parameters set in the step S41. In step S43, if the data are ready for the next page printing, the process will return to the step S38 to set the offset amount anew and repeat the printing in the same procedures.

With the driving sequence described as above, the variable offset amounts are exactly obtained from the difference between the actual in-apparatus temperature and head temperature with respect to the duties of the printing pattern, hence making it possible to reduce the difference between print densities.

(Another Embodiment)

Also, in the above-mentioned embodiments, the offset amount is set per page in order to change the driving parameters, but the present invention is not limited to these embodiments. It may be possible to do the same per line or per given amount to be recorded. It may also be possible to arrange the structure so that this can be done arbitrarily during a recording operation.

As an example of driving parameters for the embodiments according to the present invention, it is stated that only the pulse P1 is changed in a method in which a plurality of pulses are applied per discharge (FIG. 11) while exemplifying a recording apparatus of an ink jet type. However, the present invention is not limited thereto. It may be possible to adopt a method in which only the period P2 for the pulse to be quiescent is varied among the driving pulses shown in FIG. 11 or a method in which both the P1 and P2 are varied at the same time. It will suffice if only the structure is arranged so that the driving parameters can be set corresponding to the head temperatures.

Also, the present invention is applicable not only to the ink jet recording, but also to a recording in which the density of the recorded image varies depending on the head temperatures like a thermal method, for example.

Also, the driving parameters to be changed are the width of the driving pulses according to the present embodiments, but the present invention is not limited thereto. It may be possible to change a driving voltage or some other parameters for the purpose.

(Still Another Embodiment)

The present invention produces an excellent effect on a recording apparatus using an ink jet recording method, particularly the one in which the flying droplets are formed by utilizing thermal energy for recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, it is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharging ports. In other words, according to the present invention, the recording is executed reliably and efficiently irrespective of the various modes of the recording head.

Furthermore, the present invention is effectively applicable to the recording head of a full-line type having a length corresponding to the maximum width of a recording medium, which is recordable by a recording apparatus. The full-line head may be the one which is structured by combining a plurality of the recording heads or a single full-line recording head which is integrally formed. Either will do.

In addition, the present invention is effectively applicable to a serial type recording head as exemplified above; to a replaceable chip type recording head which is electrically connected to the main apparatus and for which the ink is supplied when it is mounted in the main assemble; or to a cartridge type recording head having an ink tank integrally provided for the head itself.

Also, it is preferable to additionally provide the recording head recovery means and preliminarily auxiliary means as constituents of the recording apparatus according to the present invention because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also contributable to executing a stabilized recording that the preliminary discharge mode is adopted aside from the regular discharging for recording.

Further, regarding the kinds or the number of the recording heads to be mounted, it may be possible to provide two or more heads corresponding to a plurality of ink having different recording colors or densities. In other words, the present invention is extremely effective in applying it not only to a recording mode in which only main color such as black or the like is used, but also to an apparatus having at least one multi-color mode with ink of different colors, or a full-color mode using the mixture of the colors, irrespective of whether the recording heads are integrally structured or it is structured by a combination of plural recording heads.

Furthermore, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given. In addition, while positively preventing the temperature rise due to the thermal energy by the use of such energy as an energy utilized for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Further, as the mode of the recording apparatus according to the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

Also, the present invention is effectively applicable to a driving method in which one pulse is applied to one ink-droplet discharging.

For the present invention, the changes of the driving parameters are not necessarily confined to those of the widths of the driving pulses, but it may be possible to change the values of voltage or current of the pulses.

According to the present invention, it is possible to maintain the discharging amount constantly in printing and between environments, and suppress the changes of the image densities by providing an offset temperature between the in-apparatus temperature sensor and the head temperature so that the head temperature is obtained by changing the offset temperatures in accordance with the situations without any direct detection of the head temperature. Also, the cost of printer main body and the cost of head can be reduced significantly.

What is claimed is:

1. A recording apparatus provided with at least one recording head which apparatus records by driving the recording head upon an application of a drive signal from a recording head driving means for driving the recording head, said apparatus experiencing a temperature rise when recording in accordance with the application of the drive signal, comprising:

means for detecting a temperature in the apparatus to detect the temperature in the recording apparatus;

means for calculating a temperature of said recording head from an offset value set between the temperature in apparatus and the temperature of said recording head of the recording apparatus in accordance with a detection by said means for detecting of the temperature in apparatus;

means for controlling the drive signal to change a waveform of the drive signal applied to said recording head, wherein said means for controlling the drive signal changes a signal width of the drive signal in accordance with the temperature of the recording head; and storing means for storing said offset value and/or the waveform of said drive signal in a table corresponding to said temperature in the apparatus.

2. A recording apparatus according to claim 1, wherein said means for controlling the drive signal changes a voltage value of said drive signal.

3. A recording apparatus according to claim 1, wherein said recording head is provided with a plurality of discharging ports to discharge an ink, and discharging means to discharge the ink from said discharging ports, and discharges the ink in response to the application of the drive signal.

4. A recording apparatus according to claim 3, wherein said drive signal is formed by a plurality of pulses per one ink-droplet discharge.

5. A recording apparatus according to claim 4, wherein said discharging means for discharging comprises an electrothermal transducing means for generating heat which generates thermal energy in accordance with the application of the drive signal, causes a change of state in the ink by a heat of said thermal energy, and discharges the ink in accordance with said change of state.

6. A recording apparatus according to claim 5, wherein said drive signal comprises a first signal which causes said discharging means to generate the thermal energy in an amount which does not cause said ink to be discharged, and a third signal which causes the ink to be discharged which is applied following an application of a second signal during a quiescent time subsequent to an application of the first signal.

7. A recording apparatus according to claim 6, wherein said means for controlling the drive signal changes a signal width of said first signal.

8. A recording apparatus according to claim 6, wherein said means for controlling the drive signal changes a signal width of said second signal.

9. A recording apparatus according to claim 6, wherein said means for controlling the drive signal changes a signal width of said first signal and a signal width of said second signal.

10. A recording method for recording using a recording apparatus having at least one recording head which apparatus records by driving the recording head upon an application of a drive signal from a recording head driving means for driving the recording head, said apparatus experiencing a temperature rise when recording in accordance with the application of the drive signal, comprising:

a step of detecting a temperature in the apparatus to detect the temperature in the recording apparatus;

a step of calculating a temperature of said recording head from an offset value set between the temperature in apparatus and the temperature of said recording head of the recording apparatus in accordance with the detecting of the temperature in the apparatus; and a step of controlling the drive signal to change a waveform of the drive signal applied to said recording head.

11. A recording method as in claim 10, wherein said recording head causes a change of a state in an ink by heat by the application of said drive signal, and discharges the ink in accordance with said change of state.

12. A recording method as in claim 11, wherein said drive signal is formed by a plurality of pulses per one ink-droplet discharge.

13. A recording method as in claim 12, wherein said drive signal comprises a first signal which causes a generation of a thermal energy in an amount which does not cause said ink to be discharged, and a third signal which causes the ink to be discharged which is applied following an application of a second signal during a quiescent time subsequent to an application of the first signal.

14. A recording method as in claim 13, wherein said controlling of the drive signal includes changing a signal width of said first signal.

15. A recording method as in claim 13, wherein said controlling of the drive signal includes changing a signal width of said second signal.

16. A recording method as in claim 13, wherein said controlling of the drive signal includes changing a signal width of said first signal and a signal width of said second signal.

17. A recording apparatus provided with at least one recording head which apparatus records by drive the recording head upon an application of a drive signal from a recording head driving means for driving the recording head, said apparatus experiencing a temperature rise when recording in accordance with the application of the drive signal, comprising:

means for detecting a temperature in the apparatus to detect the temperature in the recording apparatus;

means for calculating a temperature of said recording head from an offset value which is determined in accordance with at least one of the temperature in the apparatus which has been detected by said means for detecting of the temperature in the apparatus, a number of sheets which have been recorded, a temperature of an environment of the recording apparatus, and a duty of an image which is to be recorded; and means for controlling the drive signal to change a waveform of the drive signal applied to said recording head, wherein said means for controlling the drive signal changes a signal width of the drive signal in accordance with the temperature of the recording head.

18. A recording apparatus according to claim 17, further comprising:

counting means for counting a number of sheets that have been recorded, wherein said offset value is set corresponding to the temperature in said recording apparatus and said number of sheets that have been recorded.

19. A recording apparatus according to claim 17, further comprising:

detecting means for detecting an environmental temperature to detect an environmental temperature, wherein said offset value is set in accordance with both the temperature in the apparatus and the environmental temperature which have been detected.

20. A recording apparatus according to claim 17, further comprising:

means for detecting a print duty of an image to be recorded, wherein said offset value is set in accordance with both the temperature in the apparatus and said print duty that have been detected.

21. A recording apparatus according to claim 17, further comprising:

means for detecting an environmental temperature to detect an environmental temperature, wherein said offset value is stored in a table so as to correspond to both said temperature in the apparatus and said environmental temperature.

22. A recording apparatus according to claim 17, further comprising:

means for detecting a print duty of an image to be recorded, wherein said offset value is set in accordance with both said temperature in the apparatus and said print duty that have been detected.

23. A recording apparatus according to claim 17, wherein said means for controlling the drive signal changes a signal width of the drive signal.

24. A recording apparatus according to claim 17, wherein said means for controlling the drive signal changes a voltage value of said drive signal.

25. A recording apparatus according to claim 17, wherein said recording head is provided with a plurality of discharging ports to discharge an ink, and discharging means for discharging the ink from said discharging ports, and discharges the ink in accordance with the application of the drive signal.

26. A recording apparatus according to claim 25, wherein said drive signal is formed by a plurality of pulses per one ink-droplet discharge.

27. A recording apparatus according to claim 26, wherein said discharging means for discharging comprises an electrothermal transducing means for generating heat which generates thermal energy in accordance with the application of said drive signal, causes a change of state in the ink by a heat of said thermal energy, and discharges the ink in accordance with said change of state.

28. A recording apparatus according to claim 27, wherein said drive signal comprises a first signal which causes said discharging means to generate the thermal energy in an amount which does not cause said ink to be discharged, and a third signal which causes the ink to be discharged which is applied following an application of a second signal during a quiescent time subsequent to an application of the first signal.

29. A recording apparatus according to claim 28, wherein said means for controlling the drive signal changes a signal width of said first signal.

30. A recording apparatus according to claim 28, wherein said means for controlling the drive signal changes a signal width of said second signal.

31. A recording apparatus according to claim 28, wherein said means for controlling the drive signal changes a signal width of said first signal and a signal width of said second signal.

32. A recording method for recording with a recording apparatus having at least one recording head which apparatus records by driving the recording head upon an application of a drive signal from a recording head driving means for driving the recording head, said apparatus experiencing a temperature rise when recording in accordance with the application of the drive signal, comprising:

a step of counting a number of recorded sheets which have been recorded by said apparatus;

a step of detecting a temperature in the apparatus to detect the temperature in the recording apparatus;

a step of calculating a temperature of the recording head from an offset value set corresponding the number of recorded sheets and the temperature in the apparatus in accordance with the detecting of the temperature in the apparatus; and a step of changing a waveform of said drive signal in accordance with said temperature of the recording head.

33. A recording method as in claim 32, wherein said recording head causes a change of a state in an ink by heat by the application of said drive signal, and discharges the ink in accordance with said change of state.

34. A recording method as in claim 33, wherein said drive signal is formed by a plurality of pulses per one ink-droplet discharge.

35. A recording method as in claim 34, wherein said drive signal comprises a first signal which causes generating of a thermal energy in an amount which does not cause said ink to be discharged, and a third signal which causes the ink to be discharged which is applied following an application of a second signal during a quiescent time subsequent to an application of the first signal.

36. A recording method as in claim 35, wherein said controlling of the drive signal includes changing a signal width of said first signal.

37. A recording method as in claim 35, wherein said controlling of the drive signal includes changing a signal width of said second signal.

38. A recording method as in claim 35, wherein said controlling of the drive signal includes changing the signal width of said first signal and a signal width of said second signal.

39. A recording method for recording using a recording apparatus having at least one recording head which apparatus records by driving the recording head upon an application of a drive signal from a recording head drive means for driving the recording head, said apparatus experiencing a temperature rise when recording in accordance with the application of the drive signal, comprising:

a step of detecting an environmental temperatures;

a step of detecting a temperature in the apparatus to detect the temperature in the recording apparatus;

a step of calculating a temperature of said recording head from an offset value set corresponding to said environmental temperature and said temperature in the apparatus in accordance with a detection of said environmental temperature and said temperature in the apparatus; and a step of changing a waveform of said drive signal in accordance with said head temperature.

40. A recording method as in claim 39, wherein said recording head causes a change of a state in an ink by heat by the application of said drive signal, and discharges the ink in accordance with said change of state.

41. A recording method as in claim 40, wherein said drive signal is formed by a plurality of pulses per one ink-droplet discharge.

42. A recording method as in claim 41, wherein said drive signal comprises a first signal which causes a generation of a thermal energy in an amount which does not cause said ink to be discharged, and a third signal which causes the ink to be discharged which is applied following an application of a second signal during a quiescent time subsequent to an application of the first signal.

43. A recording method as in claim 42, wherein said controlling of the drive signal includes changing a signal width of said first signal.

44. A recording method as in claim 42, wherein said controlling of the drive signal includes changing a signal width of said second signal.

45. A recording method as in claim 42, wherein said controlling of the drive signal includes changing a signal width of said first signal and a signal width of said second signal.

46. A recording method for recording using a recording apparatus having at least one recording head which apparatus records by driving the recording head upon an application of a drive signal from a recording head driving means for driving the recording head, said apparatus experiencing a temperature rise when recording in accordance with the application of the drive signal, comprising:

a step of detecting a print duty of an image to be recorded;

a step of detecting a temperature in the apparatus to detect a temperature in the recording apparatus;

a step of calculating a temperature of said recording head from an offset value set corresponding to said print duty and said temperature in the apparatus in accordance with a detection of said print duty and said temperature in the apparatus; and a step of changing a waveform of said drive signal in accordance with said temperature of the recording head.

47. A recording method as in claim 46, wherein said recording head causes a change of a state in an ink by heat by the application of said drive signal, and discharges the ink in accordance with said change of state.

48. A recording method as in claim 47, wherein said drive signal is formed by a plurality of pulses per one ink-droplet discharge.

49. A recording method as in claim 48, wherein said drive signal comprises a first signal which causes a generation of a thermal energy in an amount which does not cause said ink to be discharged, and a third signal which causes the ink to be discharged which is applied following an application of a second signal during a quiescent time subsequent to an application of the first signal.

50. A recording method as in claim 49, wherein said controlling of the drive signal includes changing a signal width of said first signal.

51. A recording method as in claim 49, wherein said controlling of the drive signal includes changing a signal width of said second signal.

52. A recording method as in claim 49, wherein said controlling of the drive signal includes changing a signal width of said first and changing a signal width of a second signal.

53. A recording apparatus provided with at least one recording head which apparatus records by driving the recording head upon an application of a drive signal from a recording head driving means for driving the recording head, said apparatus experiencing a temperature rise when recording in accordance with the application of the drive signal, comprising:

a first temperature detecting means for detecting a temperature in which no correction of an absolute temperature is made;

a second temperature detecting means for detecting a temperature in which the absolute temperature is corrected; and means for controlling the drive signal to change a waveform of said drive signal in accordance with an offset temperature calculated from the temperatures detected by said first and said second temperature detecting means, and a recording head temperature is calculated from an output value of said second temperature detecting means, wherein said means for controlling the drive signal changes a signal width of the drive signal in accordance with the temperature of the recording head.

54. A recording apparatus according to claim 53, wherein said first temperature detecting means detects a temperature in the apparatus, and said second temperature detecting means detects the recording head temperature.

55. A recording apparatus according to claim 53, wherein each said recording head is provided with a plurality of discharging ports to discharge an ink, and discharging means to discharge the ink from said discharging ports, and discharges the ink in accordance with the application of the drive signal.

56. A recording apparatus according to claim 55, wherein said drive signal is formed by a plurality of pulses per one ink-droplet discharge.

57. A recording apparatus according to claim 56, wherein said discharging means for recording comprises an electro-thermal transducing means which generates thermal energy in accordance with the application of drive signals, causes a change of a state in the ink by a heat of said thermal energy, and discharges the ink in accordance with said change of state.

58. A recording apparatus according to claim 57, wherein said drive signal comprises a first signal which causes said discharging means to generate the thermal energy in an amount which does not cause said ink to be discharged, and a third signal which causes the ink to be discharged which is applied following an application of a second signal during a quiescent time subsequent to an application of the first signal.

59. A recording apparatus according to claim 58, wherein said means for controlling the drive signal changes a signal width of said first signal.

60. A recording apparatus according to claim 58, wherein said means for controlling the drive signal changes a signal width of said second signal.

61. A recording apparatus according to claim 58, wherein said means for controlling the drive signal changes a signal width of said first signal and changes a signal width of said second signal.

62. An ink jet recording apparatus for executing recording on a recording medium by utilizing an ink jet recording head provided with a recording element, which head discharges ink by driving the recording element, the apparatus comprising:

means for obtaining a temperature in the apparatus;

means for obtaining a condition relating to a recording operation; and control means for determining an offset value for representing a difference between the temperature in the apparatus and said ink jet recording head based on an obtained temperature in the apparatus and obtained condition, calculating a temperature of said ink jet recording head and setting a drive signal of said recording element of said ink jet recording head based on the calculated temperature of said ink jet recording head.

63. An ink jet recording apparatus according to claim 62, wherein the condition relating the recording operation is a sheet number of the recording medium which has executed the recording operation.

64. An ink jet recording apparatus according to claim 62, wherein the condition relating to the recording operation is determined by an image data corresponding to an image to be recorded.

65. An ink jet recording apparatus according to claim 64, wherein the condition relating to the recording operation is a recording duty represented by the image data.

66. A recording apparatus according to claim 62, wherein said drive signal is formed by a plurality of pulses per one ink-droplet discharge.

67. A recording apparatus according to claim 66, wherein said discharging means for discharging comprises an electrothermal transducing means for generating heat which generates thermal energy in accordance with the application of the drive signal, causes a change of state in the ink by a heat of said theremal energy, and discharges the ink in accordance with said change of state.

68. A recording apparatus according to claim 67, wherein said drive signal comprises a first signal which causes said discharging means to generate the thermal energy in an amount which does not cause said ink to be discharged, and a third signal which causes the ink to be discharged which is applied following an application of a second signal during a quiescent time subsequent to an application of the first signal.

69. A recording apparatus according to claim 68, wherein said means for controlling the drive signal changes a signal width of siad first signal.

70. A recording apparatus according to claim 68, wherein said means for controlling the drive signal changes a signal width of said second signal.

71. A recording apparatus according to claim 68, wherein said means for controlling the drive signal changes a signal width of said first signal and a signal width of said second signal.

72. An ink jet recording method for executing recording on a recording medium by utilizing an ink jet recording head provided with a recording element, which head discharges ink by driving the recording element, comprising:

a step of obtaining a temperature in the apparatus;

a step of obtaining a condition relating to a recording operation;

a setting step of setting a driving condition of said recording element of said ink jet recording head; and a step of driving said recording element of said ink jet recording head in accordance with a set driving condition, wherein said setting step comprises:

a step of determining an offset value representing a difference between the temperature in the apparatus and said ink jet recording head based on an obtained temperature in the apparatus and an obtained condition;

a step of calculating a temperature of said ink jet recording head based on a determined offset value; and a step of setting a drive signal for driving said recording element of said ink jet recording head based on a calculated temperature of said ink jet recording head.

73. An ink jet recording apparatus according to claim 72, wherein the condition relating the recording operation is a sheet number of the recording medium which has executed the recording operation.

74. An ink jet recording apparatus according to claim 72, wherein the condition relating to the recording operation is determined by an image data corresponding to an image to be recorded.

75. An ink jet recording apparatus according to claim 74, wherein the condition relating to the recording operation is a recording duty represented by the image data.

76. A recording apparatus according to claim 72, wherein said drive signal is formed by a plurality of pulses per one ink-droplet discharge.

77. A recording apparatus according to claim 76, wherein said discharging means for discharging comprises an electrothermal transducing means for generating heat which generates thermal energy in accordance with the application of the drive signal, causes a change of state in the ink by a heat of said thermal energy, and discharges the ink in accordance with said change of state.

78. A recording apparatus according to claim 77, wherein said drive signal comprises a first signal which causes said discharging means to generate the thermal energy in an amount which does not cause said ink to be discharged, and a third signal which causes the ink to be discharged which is applied following an application of a second signal during a quiescent time subsequent to an applicaton of the first signal.

79. A recording apparatus to claim 78, wherein said means for controlling the drive signal changes a signal width of said first signal.

80. A recording apparatus according to claim 78, wherein said means for controlling the drive signal changes a signal width of said second signal.

81. A recording apparatus according to claim 78, wherein said means for controlling the drive signal changes a signal width of said first signal and a signal width of said second signal.

* * * * *

UNITED STATES PATENT AND TRADEMARK OFFICE

CERTIFICATE OF CORRECTION

PATENT NO. : 6,109,718
DATED : August 29, 2000
INVENTOR(S) : Shuichi Murakami et al.

It is certified that error appears in the above-identified patent and that said Letters Patent is hereby corrected as shown below:

COLUMN 2:
Line 10, "patent application" should read --Patent Application--;
Line 62, "differenc" should read --difference--.

COLUMN 4:
Line 1, "et al" should read --et al.--;
Line 65, "assemble;" should read --assembly;--.

COLUMN 10:
Line 22, "it" should be deleted;
Line 23, "is" should be deleted.

COLUMN 11:
Line 51, "a" (second occurrence) should read --the--.

COLUMN 12:
Line 29, "a" (second occurrence) should be deleted;
Line 46, "drive" should read --driving--.

COLUMN 14:
Line 55, "temperatures;" should read --temperature;--.

UNITED STATES PATENT AND TRADEMARK OFFICE

CERTIFICATE OF CORRECTION

PATENT NO. : 6,109,718
DATED : August 29, 2000
INVENTOR(S) : Shuichi Murakami et al..

It is certified that error appears in the above-identified patent and that said Letters Patent is hereby corrected as shown below:

COLUMN 15:
Line 49, "a" (second occurrence) should be deleted.

COLUMN 16:
Line 36, "drive signals," should read --the drive signal,--.

COLUMN 17:
Line 26, "theremal" should read --thermal--;
Line 38, "siad" should read --said--.

COLUMN 18:
Line 43, "apparatus" should read --apparatus according--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*